US005144206A

United States Patent [19]

Butler et al.

[11] Patent Number: 5,144,206

[45] Date of Patent: Sep. 1, 1992

[54] ELECTRODELESS HID LAMP COUPLING STRUCTURE WITH INTEGRAL MATCHING NETWORK

[75] Inventors: Scott J. Butler, N. Oxford; Walter P. Lapatovich, Marlborough; Jason Bochinski, Natick, all of Mass.

[73] Assignee: GTE Products Corporation, Danvers, Mass.

[21] Appl. No.: 757,094

[22] Filed: Sep. 10, 1991

[51] Int. Cl.[5] ..... H05B 41/16

[52] U.S. Cl. ..... 315/248; 315/344; 315/39

[58] Field of Search ..... 315/248, 39, 111.51, 315/344, 3.5; 313/234, 607

[56] References Cited

U.S. PATENT DOCUMENTS

| | | | |
|---|---|---|---|
| 3,943,403 | 3/1976 | Haugsjaa et al. | 315/39 |
| 3,993,927 | 11/1976 | Haugsjaa | 315/248 |
| 4,001,632 | 1/1977 | Haugsjaa et al. | 315/39 |
| 4,002,944 | 1/1977 | McNeill et al. | 315/39 |
| 4,266,162 | 5/1981 | McNeill | 315/248 |
| 4,629,940 | 12/1986 | Gagne | 315/111.51 |

*Primary Examiner*—Eugene R. LaRoche
*Assistant Examiner*—A. Zarabian
*Attorney, Agent, or Firm*—Carl F. Ruoff; Victor F. Lohmann, III

[57] ABSTRACT

The present invention describes an electrodeless HID lamp fixture which utilizes conventional microwave printed circuit material to provide both coupling and impedance matching functions. The fixture provides a steady state input impedance of a predetermined (e.g. 50 Ω or 75 Ω) value allowing direct connection to a RF power supply. Microwave power is applied at the input of the impedance matching network/balun which transforms the steady-state impedance of the lamp to the predetermined value. The network include a quarter wave transformer having a shunt capacitor coupled to balun-applicator which supplies microwave power to the lamp. In a preferred embodiment, the quarter wave transformer, shunt capacitor and balun are all manufactured on a microstrip.

20 Claims, 2 Drawing Sheets

ELECTRODELESS HID LAMP COUPLING STRUCTURE WITH INTEGRAL MATCHING NETWORK

BACKGROUND OF THE INVENTION

The present invention relates to electrodeless light sources and more particularly, to a lighting fixture which provides coupling and impedance matching of the power to the lamp. The fixture provides a nominal steady state input impedance of a predetermined value (e.g. 50 or 75Ω), thereby allowing direct connection via conventional transmission line techniques to a RF power source (e.g. 915 or 2450 MHz).

Microwave electrodeless high intensity discharge (HID) lamps have been coupled to power sources using termination fixtures which are typically large, bulky, shielded coaxial structures. Examples of such fixtures are described in U.S. Pat. Nos. 3,943,403 and 4,002,944. These termination fixtures make the electrodeless lamp undesirable for many applications due to the optical characteristics.

More recently a novel dual ended excitation scheme as taught by Lapatovich in U.S. patent applications Ser. No. 07/523,761 and 07/524,265 has resulted in considerable size and weight reduction of the lamp as well as improved optical characteristics. However this coupling structure as taught by Lapatovich requires an external variable impedance matching means which is bulky and expensive. An example of a variable impedance matching means (e.g. stub tuner) is described in U.S. Pat. No. 4,001,632.

The present invention combines the dual ended excitation scheme with an integral impedance matching network on the same printed circuit board as the balun-/applicator as taught in U.S. patent application Ser. No. 07/523,761 and 07/524,265. Since the impedance matching network is integral to the coupling structure, and not separated by connectors and/or coaxial cable, the resulting system performance is less dependent on subtle manufacturing variations. In addition, the tuning network of the present invention is compact, lightweight, inexpensive, and rugged making it a more commercially attractive product than previous attempts at impedance matching.

SUMMARY OF THE INVENTION

The present invention describes an integral matching network which utilizes conventional microwave printed circuit material to provide coupling and impedance matching functions. The fixture includes a quarter wave transformer having an input end and an output end. A shunt capacitor is coupled to the input end and a first applicator is coupled to the output end. The first applicator faces a gap for containing a lamp capsule. A second applicator is positioned coaxially with the first coupler and coupled to the first coupler in a manner to cause the first and second coupler to be approximately 180° out of phase. The shunt capacitor is used to resonate the apparent shunt inductance of the network to a predetermined impedance. The resulting apparatus provides coupling and impedance matching on a single card.

The method of designing such a network is also disclosed.

For a better understanding of the present invention, together with other and further advantages and capabilities thereof, reference is made to the following disclosure and appended claims in connection with the above described drawings.

DETAILED DESCRIPTION OF PREFERRED EMBODIMENTS

The present invention describes an HID lamp fixture which utilizes conventional microwave printed circuit materials and provides both coupling and impedance matching functions. The fixture described provides nominal steady state impedance of 50 Ω, however other steady state impedance levels are possible. The impedance of the fixture is dependent on the characteristics of the lamp envelope and fill.

Figure 1:
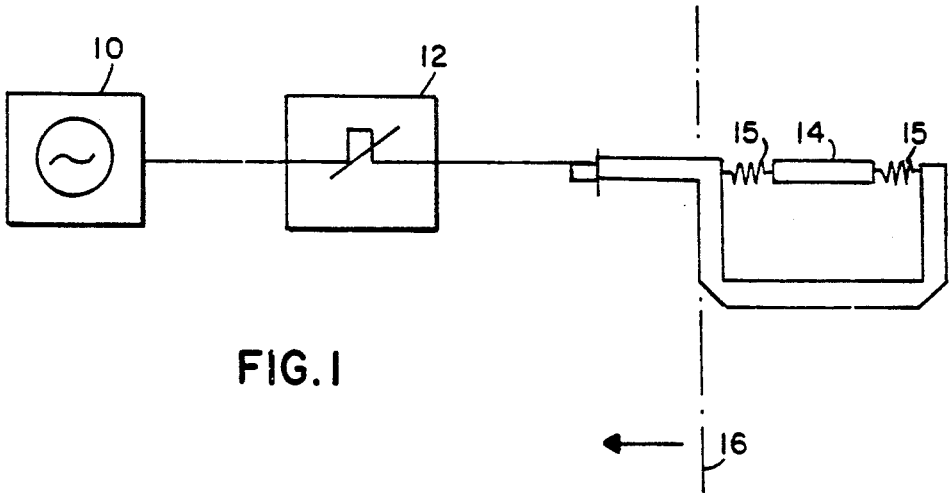
FIG. 1 shows the experimental equipment used to determine impedance of the lamp capsule and applicators.

FIG. 1 shows the assembly used to determine the impedance on a number of lamp envelopes. The assembly included a magnetron source 10 which produced an RF signal at 915 MHz. A stub tuner 12 was used to match the impedance of the incoming signal with the impedance of the lamp capsule 14. The impedance of the lamp 14 and helical applicators 15 were then determined by measuring the impedance presented by the stub tuner 12 at the reference plane 16, and suitably de-embedding the complex conjugate of this measured impedance to the input terminals of the applicators. This is a commonly used substitution method of determining impedance. The RF signal was coupled to the lamp capsule 14 by helical coils 15 although other coupling schemes such as cups or loops are possible. The power signal to the lamp is split at the reference plane 16 so that the microstripline has a length equal to approximately one-half wavelength. This half wavelength extension constitutes a balun impedance transformer and provides a 4 to 1 impedance reduction.

The lamp capsules used to determine impedance in the present invention had an internal length of 10 millimeters, an inner diameter of 2 mm and an outer diameter of 3 mm. The lamp capsules were filled with varying amounts of mercury, ranging from 0.045 mg Hg to 0.60 mg Hg. Lamps typically contained 0.1 mg of NaI $ScI_3$ salt of standard molar content i.e. (11.4 to 1 Na to Sc).

The helical coils 15 used in the present invention have the same rotational sense (e.g. both have right handed coils) but the opposite rotational sense may be used. The opposed ends of the couplers are separated by a gap having a length of about one quarter of the compressed wavelength. The lamp capsule 14 is positioned coaxially between the couplers.

The helical coils were made from gold plated nickel wire having a 0.5 mm diameter. The outer diameter of the helical couplers was 5.0 mm and the pitch was 1.22 mm for 5.6 turns of coil. The lamp capsule was made of water free quartz although other materials are possible.

The impedance measured is the impedance of the lamp and helical coils 15. The resistive and reactive components of the lamp and helical coils are determined simultaneously and are not resolved independently.

Nevertheless, it is possible to match the source impedance to this convolved impedance without explicitly knowing the lamp impedance. It was found that the resistive part of the convolved impedance over the range of applied power (between 2 and 30 Watts) was essentially flat with a value of approximately 100 Ω. This range was approximately constant for the range of mercury pressures studied. The circuit designed was optimized for this impedance and the schematic is shown in FIG. 2.

Figure 2:
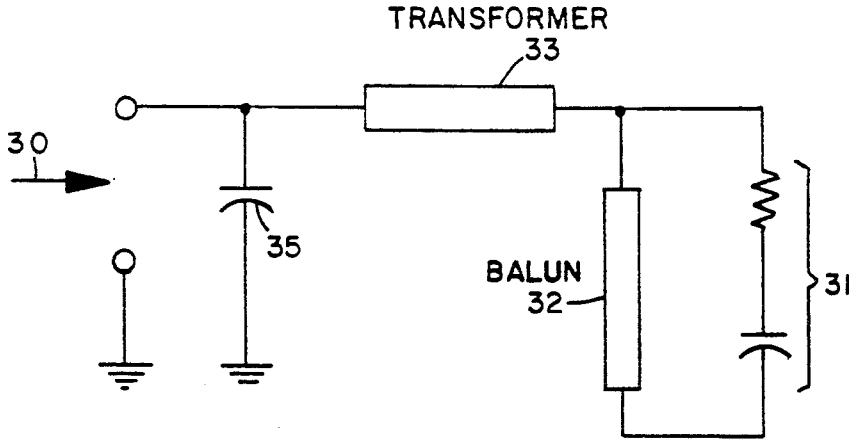
FIG. 2 shows a schematic representation of the present invention.

In FIG. 2 microwave power is applied at the input 30 of the impedance matching network/balun which transforms the steady-state impedance of the lamp and helices to 50 Ω. The net impedance of the lamp and helices can be closely approximated as a series resistor-capacitor 31 combination; and this effective impedance is transformed down by a factor of four by the half-wave balun 32. Thus, the input impedance at the half-wave balun can also be approximated by a series R-C network. A single-section microstrip quarter-wave transformer 33 is then used to transform the real part of the impedance to a 50 Ω effective shunt resistance. The immitance inversion property of the quarter-wave transformer 33 results in an apparent shunt inductance at the input of the transformer. (i.e. the series capacitance is transformed to a shunt inductance.) A shunt capacitor 35 (which can be realized as a fixed lumped or distributed element or as a mechanically variable or voltage variable element) is subsequently used to resonate the apparent shunt inductance resulting in a nominal 50 Ω input impedance. While the equivalent circuit representation of the lamp and helices used in this example is that of a series R-C network, similar matching means would be apparent to one skilled in the art if alternate coupling geometries, such as end cups, loops, etc. were used as applicators. A novel feature of the instant invention is the use of microstrip transmission line segments and miniature shunt capacitors to make the matching network/applicator compact as required in miniaturized HID lamps. A useful and desirable feature of the instant invention is that the tuning (matching) network is applied in a continuous fashion, mating with the balun/applicator. This eliminates multiple connectors which are bulky and expensive and reduces reflectance and power loss.

Figure 3:
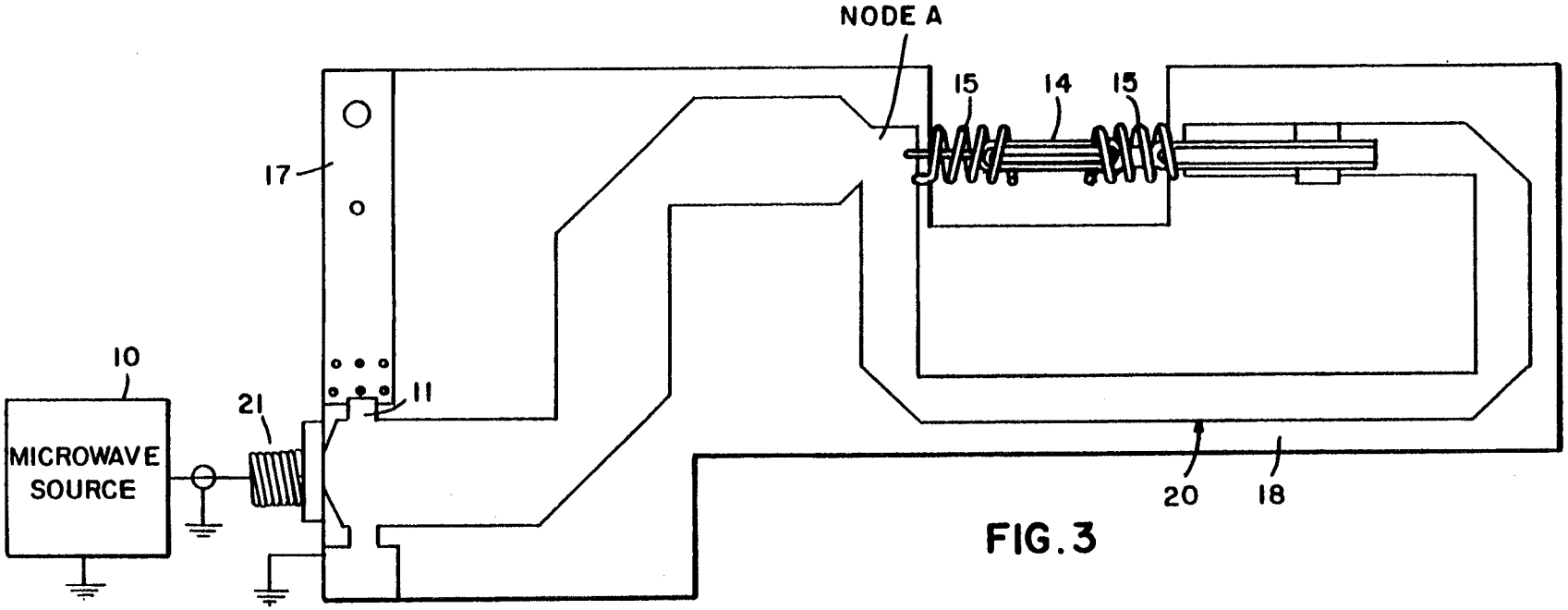
FIG. 3 shows the complete assembly of the present invention.

The assembly of the complete circuit including the lamp and applicators is shown in FIG. 3. Approximately 20 of these lamp assemblies have been fabricated and tested. Each of these assemblies provides about 2000 lumens at an input power level of 25 W at 915 MHz with a steady-state input VSWR of less than 1.5:1. While this work was done at 915 MHz (an allowed ISM band in the Western Hemisphere) it is apparent to one skilled in the art that these techniques could be applied at any frequency and specifically at other allowed ISM frequencies such as 2450 MHz.

FIG. 3 shows the assembly of the complete circuit of the present invention, including the lamp envelope 14 and the slow wave coupling coils 15. The complete assembly includes a microwave source 10, a high frequency stripline launcher 21 and the printed circuit 18 with the integral impedance matching network. The ground plane 17 is on the reverse side of the printed circuit 18. The microwave source 10 produces a radio frequency signal that is coupled to the lamp 14 through the microstripline 20 and helical couplers 15. A coaxial stripline launcher 21 couples the input power signal from the microwave source 10 to the conductive strip 20. The impedance matching network comprises the portion of the microstripline 20 extending from the high frequency stripline launcher 21 to node A including the fixed tuning capacitor 11. The power signal is split at node A by making the remainder of the microstripline equal to about one half wavelength. By properly adjusting the length of the microstripline extension, the two helical couplers 15 deliver power 180° out of phase to the lamp envelope 14. This half wavelength extension constitutes a balun impedance transformer and provides a 4 to 1 reduction in impedance variation to the microwave power source 10.

The quarter-wave transformer and half-wavelength extension may be fabricated in either microstrip, stripline, or slabline form.

The lamp capsule 14, helical coils or coupler 15 and lamp fill were the ones used to determine impedance and have been described in detail previously.

While there has been shown what are at present considered to be the preferred embodiments of the invention various modifications and alterations will be obvious to those skilled in the art. All such modifications are intended to fall within the scope of the appended claims.

What is claimed is:

1. An integral RF applicator and impedance matching network comprising a first helical coupler receiving input power at a first end and having a second end facing a gap to contain a lamp capsule;

a second helical coupler positioned coaxial with said first helical coupler, receiving input power at a first end and having a second end facing the gap to contain the lamp capsule with coupling means which delay power to the second helical coupler to cause the first and second coupler to be approximately 180° out of phase; and a quarter-wave transformer having a first end coupled to the first end of the first helical coupler and a second end coupled to a shunt reactance and a high frequency power supply.

2. The applicator and matching network according to claim 1 wherein the shunt reactance comprises a fixed capacitor.

3. The applicator and matching network according to claim 2 where said fixed capacitor has a capacitance of approximately 4 pico Farads.

4. The integral RF applicator and matching network according to claim 1 wherein the quarter-wave transformer and coupling means are fabricated in microstrip, stripline or slabline form.

5. An integral RF applicator and impedance matching network comprising:

a quarter wave transformer having an input and an output end;

a shunt capacitor coupled to the input end of the quarter wave transformer having means to vary the capacitance of said capacitor;

a half wavelength balun coupled to the output end of said quarter wave transformer having a first end and second end opposing each other; and a first microwave applicator and a second microwave applicator attached to the first and second ends of said half wavelength balun, wherein said shunt capacitor is used to resonate an apparent shunt inductance of the network to predetermined input impedance.

6. The network according to claim 5 wherein the shunt capacitor is manually adjustable.

7. The network according to claim 5 wherein the shunt capacitor is voltage adjustable.

8. The network according to claim 5 wherein the predetermined input impedance is 50 Ω.

9. The network according to claim 5 wherein the predetermined input impedance is 75 Ω.

10. The network according to claim 5 wherein the matching network is fabricated in microstrip form.

11. The network according to claim 5 wherein said first and second applicators are helical coils.

12. The network according to claim 5 wherein said first and second applicators are cups.

13. The network according to claim 5 wherein said first and second applicators are loops.

14. The network of claim 5 wherein the designed operating frequency is between 902 and 927 MHz.

15. The network of claim 5 wherein the designed operating frequency is between 2400 and 2500 Mhz.

16. A method of designing matching network for an RF applicator and an electrodeless lamp comprising:

applying RF power to one or more RF applicators coupled to an electrodeless lamp;

matching the impedance of the incoming RF power signal with the impedance of the electrodeless lamp and the one or more RF applicators;

measuring the matched impedance of the electrodeless lamp and the one or more applicators;

approximating the measured impedance of the lamp and applicators as a series R-C network;

determining a shunt inductance for a quarter-wave transformer coupled the RF applicators from the approximated R-C network.

17. The method according to claim 16 wherein the one or more RF applicators are coupled to a half-wave balun.

18. The method according to claim 16 wherein the one or more applicators are helical coils.

19. The method according to claim 16 wherein the one or more applicators are cups.

20. The method according to claim 16 wherein the one or more applicators are loops.

* * * * *